US007192061B2

(12) United States Patent
Martin

(10) Patent No.: US 7,192,061 B2
(45) Date of Patent: Mar. 20, 2007

(54) BIRTHDAY CALENDAR

(76) Inventor: Judy A. Martin, P.O. Box 398, Calhoun, MS (US) 38916

( * ) Notice: Subject to any disclaimer, the term of this patent is extended or adjusted under 35 U.S.C. 154(b) by 123 days.

(21) Appl. No.: 10/685,406

(22) Filed: Oct. 16, 2003

(65) Prior Publication Data

US 2005/0082816 A1 Apr. 21, 2005

(51) Int. Cl.
*B42D 5/04* (2006.01)
*B42D 15/00* (2006.01)

(52) U.S. Cl. ..... 283/2; 283/115; 283/117; 281/39; 40/107; 40/661; 434/408; 19/20; 19/25

(58) Field of Classification Search ..... 283/2, 283/115, 117; 40/107, 661; 281/39; 434/408; D19/20, 25
See application file for complete search history.

(56) References Cited

U.S. PATENT DOCUMENTS 1,222,612 A 4/1917 Evans
1,526,166 A * 2/1925 Manahan ..... 40/109
1,536,429 A * 5/1925 Ferdon ..... 40/119
1,583,666 A * 5/1926 Crooker ..... 40/107
2,068,214 A * 1/1937 Winford ..... 40/121
2,179,857 A * 11/1939 Lowenthal ..... 40/107
2,789,763 A * 4/1957 Renaudin ..... 235/89 R
2,909,202 A 10/1959 Rock
3,290,812 A * 12/1966 Hunkins ..... 40/107
3,838,530 A * 10/1974 Schelling, Jr. ..... 40/107
4,028,826 A * 6/1977 Brandifino et al. ..... 40/110
4,176,478 A * 12/1979 Brewer ..... 40/107
4,218,077 A 8/1980 Ember
4,241,526 A * 12/1980 Poritz ..... 40/110
4,708,490 A * 11/1987 Arber ..... 368/28
4,720,123 A * 1/1988 Chelius ..... 283/2
4,794,711 A 1/1989 Christensen
4,852,282 A * 8/1989 Selman ..... 40/711
5,033,215 A * 7/1991 Newberry et al. ..... 40/107
5,123,191 A * 6/1992 Kim ..... 40/358
5,195,262 A * 3/1993 Roane ..... 40/109
5,313,722 A * 5/1994 Ackerman ..... 40/110
5,316,342 A * 5/1994 Almo ..... 283/2
D350,153 S * 8/1994 Jabbar ..... D19/20

(Continued)

FOREIGN PATENT DOCUMENTS

GB 2 124 413 A 2/1984

(Continued)

*Primary Examiner*—Monica Carter
*Assistant Examiner*—Mark Henderson
(74) *Attorney, Agent, or Firm*—Richard C. Litman

(57) ABSTRACT

The birthday calendar is a dual monthly calendar and twelve-month chart. The calendar is perpetual in that it is not designated for any particular year or month. The monthly calendar is made of a dry-erase board displaying a month grid that is filled in with erasable ink for any particular month. The chart is a grid used to permanently record and display birth dates and other annual dates such as anniversaries and holidays. The chart displays columns intersected by rows. The columns are grouped in twelve sets of two having a month column adjacent to a year column. The rows display the dates of each month down the left side of the chart, numbered from 1–31. An event is recorded in the chart by writing the event's name in the appropriate month and date space and the year in the adjacent year space.

10 Claims, 6 Drawing Sheets

U.S. PATENT DOCUMENTS 5,386,655 A * 2/1995 Jones ..... 40/119
5,431,450 A 7/1995 Coleman
5,573,404 A * 11/1996 Stawski, II ..... 434/238
5,655,319 A * 8/1997 LeCompte ..... 40/107
5,661,918 A * 9/1997 Malcolm et al. ..... 40/107
5,690,364 A * 11/1997 Oleske et al. ..... 283/2
5,799,423 A * 9/1998 Malino ..... 40/107
D411,569 S * 6/1999 Crooks et al. ..... D19/20
5,987,825 A * 11/1999 Rosen ..... 52/36.1
6,289,615 B1 * 9/2001 Kytlica ..... 40/119
6,324,777 B1 * 12/2001 Ngan ..... 40/107
6,381,885 B1 * 5/2002 Ficco, Jr. ..... 40/107
6,690,912 B1 * 2/2004 Vaughn ..... 434/308
2002/0074792 A1 * 6/2002 Newell ..... 283/2

FOREIGN PATENT DOCUMENTS

JP 409048186 A * 2/1997

* cited by examiner

BIRTHDAY CALENDAR

BACKGROUND OF THE INVENTION

1. Field of the Invention

The present invention relates to calendars, and more particularly to a dual monthly calendar and a twelve-month chart used to record dates and provide an overall view of events on one page.

2. Description of the Related Art

Remembering birth dates or other recurring occasions can be difficult when several birthdays or events are involved. For example, one not only has to remember important dates of immediate family members, but also of extended family members, such as aunts, uncles, cousins, grandparents, etc. People who rely on memory to recall dates are subject to human error. A better way to recall events is by writing them down on a calendar or a piece of paper. Using calendars, however, is not problem-free. For example, many calendars only display one month at a time, so one must flip through the calendar to the other months to see when future events will arise. Also, most calendars are discarded after the calendar year expires, so that events recorded on an expired calendar must be transcribed to a new calendar. In some cases calendars do not provide space for recording events, so important dates must be copied from the calendar to some other reminder document. In either instance, problems exist, such as improper transcription of dates or misplacement of pieces of paper that have information recorded on it. Several calendars have been developed that are perpetual and others have been developed that provide the user with space to record information.

U.S. Pat. No. 2,909,202, issued to Rock on Oct. 20, 1959, describes a calendar for recording important events. The calendar uses blank month sheets that allow the user to fill in the name of the month, the dates of the month and important events in the space provided. After one use, the calendar sheet is discarded. U.S. Pat. No. 4,218,077, issued to Ember on Aug. 19, 1980, describes a blank six-month chart. The device consists of six individual blank month grids on one page used to display and record events for any six-month period.

U.S. Pat. No. 4,794,711, issued to Christensen on Jan. 3, 1989, describes a perpetual calendar that uses memo cards to record important dates and anniversaries. The memo cards are inserted into a calendar consisting of pockets for each date of the month. British Patent Number 2,124,413, published on Feb. 15, 1984, describes a perpetual calendar assembly where memo cards are inserted into numbered date pockets, and month indicating cards and day indicating cards are inserted into month and day pockets, respectively, to display the appropriate month and day of the year. U.S. Pat. No. 5,655,319, issued to LeCompte on Aug. 12, 1997, describes a perpetual recordation calendar that is folded along designated lines to display the appropriate dates for a particular month.

Other calendars displaying one month per page are disclosed in U.S. Pat. No. 5,316,342, issued to Almo on May 31, 1994 (calendar sheet is divided into an upper half and a lower half, the lower half displaying a pre-designated month and the upper half being left blank to display art work) and U.S. Pat. No. 1,222,612, issued to Evans on Apr. 17, 1917 (twelve-sheet memorandum calendar providing space to record information).

Still other calendars are described in U.S. Pat. No. 4,720,123, issued to Chelius on Jan. 19, 1988 (a year-specific calendar displaying twelve months divided among two columns and a third column that lists important events and holidays) and U.S. Pat. No. 5,431,450, issued to Coleman on Jul. 11, 1995 (medication management calendar-chart that uses a dry-erase board).

None of the above inventions and patents, taken either singly or in combination, is seen to describe the instant invention as claimed. Thus a birthday calendar solving the aforementioned problems is desired.

SUMMARY OF THE INVENTION

The birthday calendar is a dual monthly calendar and twelve-month chart. The calendar is perpetual in that it is not designated for any particular year or month. The monthly calendar is made of a dry-erase board displaying a month grid that is filled in with erasable ink for any particular month. The chart is a grid used to permanently record and display birth dates and other annual dates, such as anniversaries and holidays. It is constructed of paper material and displays columns intersected by rows. The columns are grouped in twelve sets of two, with a month column adjacent to a year column. The rows display the dates of each month down the left side of the chart, numbered from 1–31. An event is recorded in the chart by writing the event's name in the appropriate month and date space, and the year in the adjacent year space.

Accordingly, it is a principal object of the invention to provide a birthday calendar that is perpetual.

It is another object of the invention to provide a birthday calendar having a chart for permanently recording important dates without indication as to any particular year.

It is a further object of the invention to provide a birthday calendar that temporarily shows one month of any year.

Still another object of the invention is to provide a perpetual birthday calendar that displays important dates of any month in any year at a glance at a single page which simultaneously shows a particular selected month in a year.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 4A is a fragmented, front view of the birthday calendar according to the present invention showing the top third of the calendar with important dates filled in.

FIG. 4B is a continuation of FIG. 4A, showing the middle third of the birthday calendar with important dates filled in.

FIG. 4C is a continuation of FIG. 4B, showing the bottom third of the birthday calendar with the dates filled in for a particular month and names of people celebrating birthdays filled in.

Similar reference characters denote corresponding features consistently throughout the attached drawings.

DETAILED DESCRIPTION OF THE PREFERRED EMBODIMENTS

Figure 1:
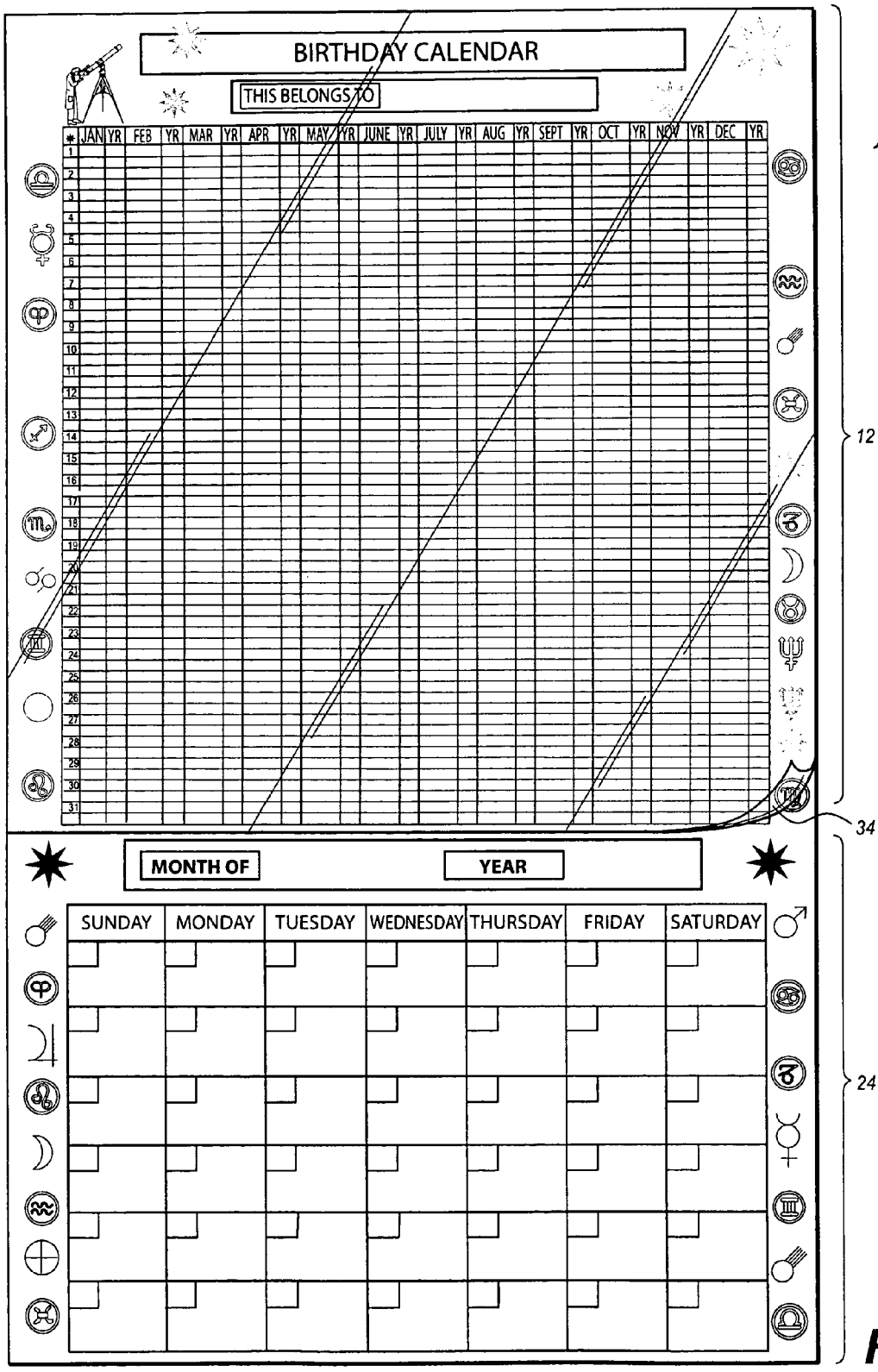
FIG. 1 is front view of the birthday calendar according to the present invention.

The present invention is a birthday calendar, designated generally as 10 in FIG. 1. The calendar 10 has two sections, a twelve-month (or annual) chart 12 and a monthly calendar 24. The chart 12 is made of construction paper, paperboard, cardboard or similar paper material that is capable of recording indelible ink, either by imprinting or written by pen, to provide a permanent record of events. The monthly calendar 24 is a dry-erase board, or similar material, that is marked by erasable ink. If desired, the monthly calendar 24 may have an anchoring piece to hold a dry-erase marker to it.

It will be understood that the term "dry-erase board" embraces any material which permits permit imprinting of the grid and indicia indicating the day of the week thereon, but provides an erasable surface for marking memoranda or notes in or over the grid spaces. Thus, the monthly calendar may be made from relatively rigid "whiteboard" or blackboard, or from a flexible material, such as paper covered by a thin sheet of flexible transparent plastic capable of accepting writing from erasable marking pens. The chart 12 and the monthly calendar 24 may be joined together in any conventional manner, e.g., by joining the two sections together by a cloth or nylon strap secured to each section, by adhering the two sections to a common backing material, by making the chart 12 and the monthly calendar on the same piece of paper or cardboard and covering them both with the same sheet or film of plastic.

The calendar 10 is rectangular in shape, preferably with the chart 12 disposed above the monthly calendar 24 or the chart 12 being disposed below the monthly calendar 24. However the calendar can take a side-by-side arrangement in which the chart 12 is adjacent to, but integral with, the monthly calendar 24, if desired. The representative dimensions of the birthday calendar are about between 31⅝ inches long and between 16 9/16 inches wide. The calendar 10 may be about as thick as a piece of paper, so that the calendar 10 can be rolled up like a poster, or the calendar 10 may be stiff and rigid. The recited dimensions, however, need not limit the present invention. Translucent plastic 34, such as Plexiglass® (a trademark of Rohm & Haas Co.), or glass is placed over the chart 12 to protect the chart 12 from water, smoke, grease and other elements. The calendar 10 can be hung on a wall by a picture hanger or other means.

Figure 2:
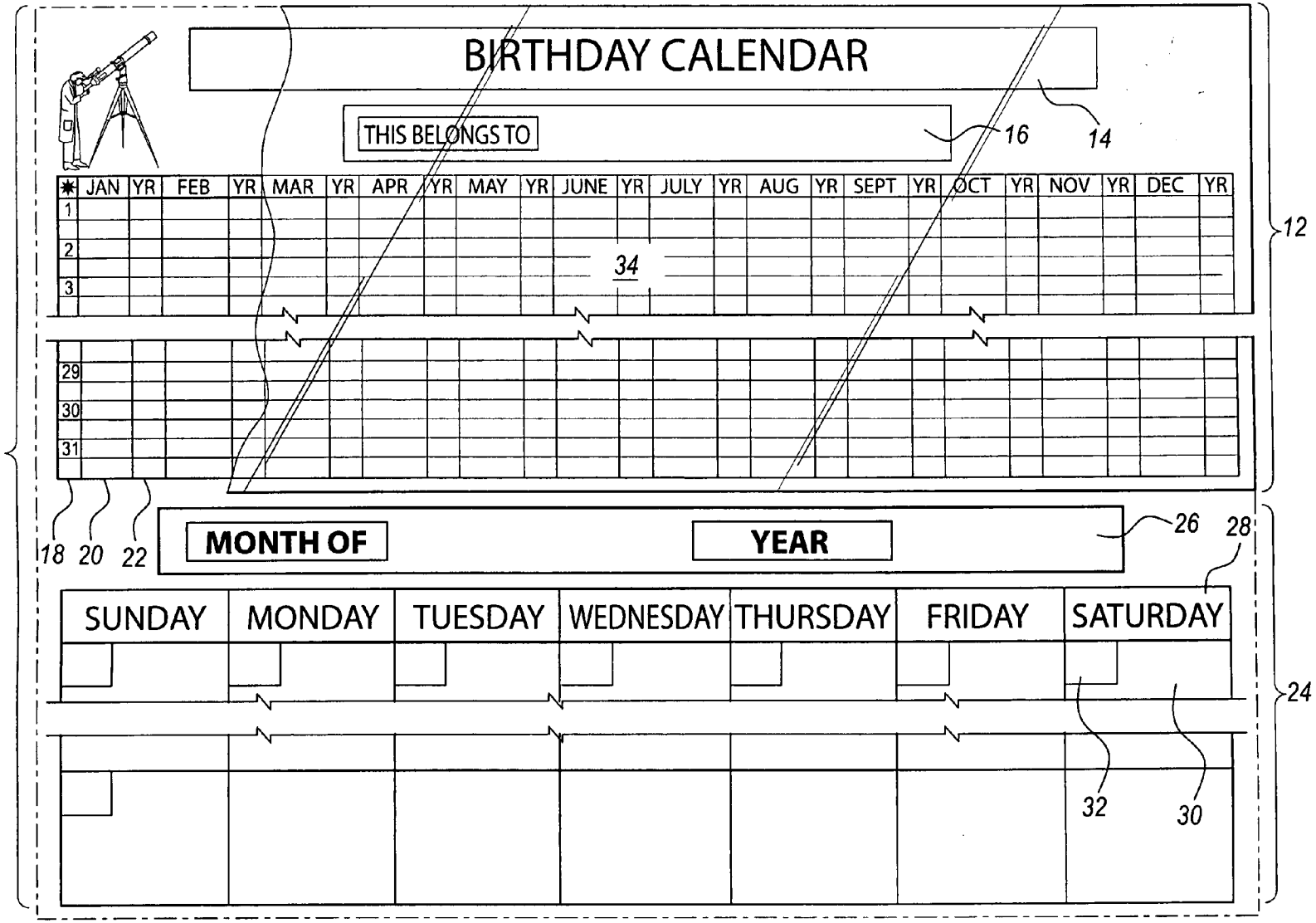
FIG. 2 is a fragmented, detail view of the birthday calendar according to the present invention.

Referring to FIG. 2, the chart 12 has two heading sections: a title section 14 and a name section 16. The title section 14 displays the words "BIRTHDAY CALENDAR"; the name section 16 displays the words "THIS CALENDAR BELONGS TO" and provides space to fill in the name of the individual to whom the calendar belongs. The chart 12 is a place to permanently record birthdays for friends, family members, celebrities or even pets, as well as to record holidays and anniversaries. As substitute titles, the title section 14 can be designated "FAMILY TREE BIRTHDAY CALENDAR", if used to record the birthdays of family members; "FRIENDS BIRTHDAY CALENDAR", if used to record the birthdays of friends; or simply "CALENDAR" if used to record dates for a combination of events or groups of people as mentioned above.

The chart 12 is a grid formed by twenty-five columns that are intersected by at least thirty-two rows. The first column of chart 12 is a date column 18 that is consecutively numbered 1–31 vertically down the left side of the chart 12 in order to display dates for all twelve months. The first space in the date column 18 is also the first space in the topmost row, and is marked with a marker, void of any information. The next twenty-four columns are divided into twelve sets of two columns each, the first column 20 being a month-indicating column 20 and the adjacent column 22 being a year-indicating column 22. In the topmost row, the month-indicating columns 20 are labeled with indicia consecutively from January to December, either abbreviated or fully written out; the adjacent year-indicating column 22 is labeled as "year" or "yr". The twelve sets of month-indicating spaces 20 and year-indicating spaces 22 in the topmost row are title headers for each of the twenty-four columns. In the preferred embodiment, the date column 18 has two rows per date, see FIGS. 1, 2, 4A and 4B, leaving space for two entries per date.

Still referring to FIG. 2, the monthly calendar 24 has a month and year title section 26 that precedes the month grid. The month and year title section 26 allows the user to temporarily write-in the particular month and year that the monthly calendar 24 is being used for. The month grid of monthly calendar 24 is formed by seven rows divided into seven columns. The first row 28 contains indicia that indicate the seven days of the week in seven respective spaces. The subsequent six rows have seven blank spaces 30 each to form a total of forty-two blank spaces in the monthly calendar 24. The forty-two blank spaces 30 provide room to write information, if desired. Each of the forty-two blank spaces 30 has smaller blank date spaces 32 defined therein to provide an area to write down the dates of the month. The date spaces 32 are preferably located in the top left corner of each of the forty-two blank spaces 30; however, the location of date spaces 32 is not critical, and the date spaces 32 can be positioned elsewhere as well. The dimensions of the blank spaces 30 are preferably about 15/16 inches long by 11/16 inches wide and the date spaces 32 are about ½ inch long by 9/16 inches wide. After the user fills in the monthly calendar 24 for a particular month the entire monthly calendar 24 is erased or wiped clean and the user fills in the dates for the subsequent month in the date spaces 32 and the year and the name of the month in the month and year title section 26. Advantageously, by providing for six rows in the monthly calendar 24, the grid has enough spaces to accommodate months with thirty-one days, even if the first day falls on a Friday or Saturday so that the thirty-one days spreads across at least a part of six weeks.

Figure 3:
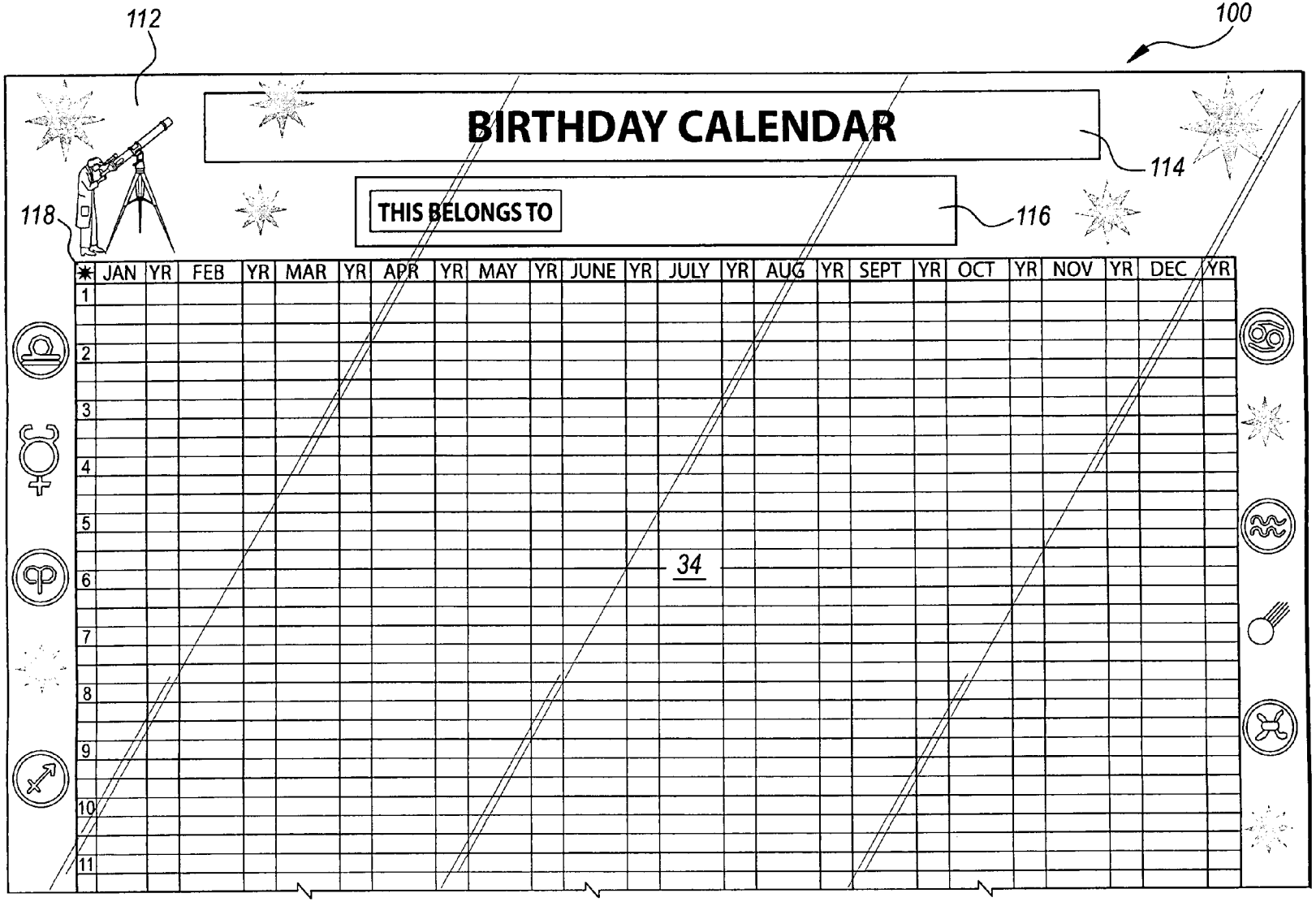
FIG. 3 is a partial view of an alternative embodiment of the birthday calendar showing only the twelve-month chart.

FIG. 3 shows an alternative embodiment of the present invention 100 having three rows per date in chart 112. The chart 112 is used in conjunction with the monthly calendar 24 as seen in FIGS. 1, 2 and FIG. 4C. It should also be mentioned that the rows per date could be just one row per date or more than three rows per date. The alternative embodiment 100, similar to the preferred embodiment 10, has a title section 114 to indicate the calendar type, a name section 116 to indicate to whom the calendar belongs, and the chart 112 is protected by translucent plastic 34. Indicia indicating the dates are formed in date column 118, and the three rows per date provide space to list names for birthdays that fall on the same date.

Figure 4A:
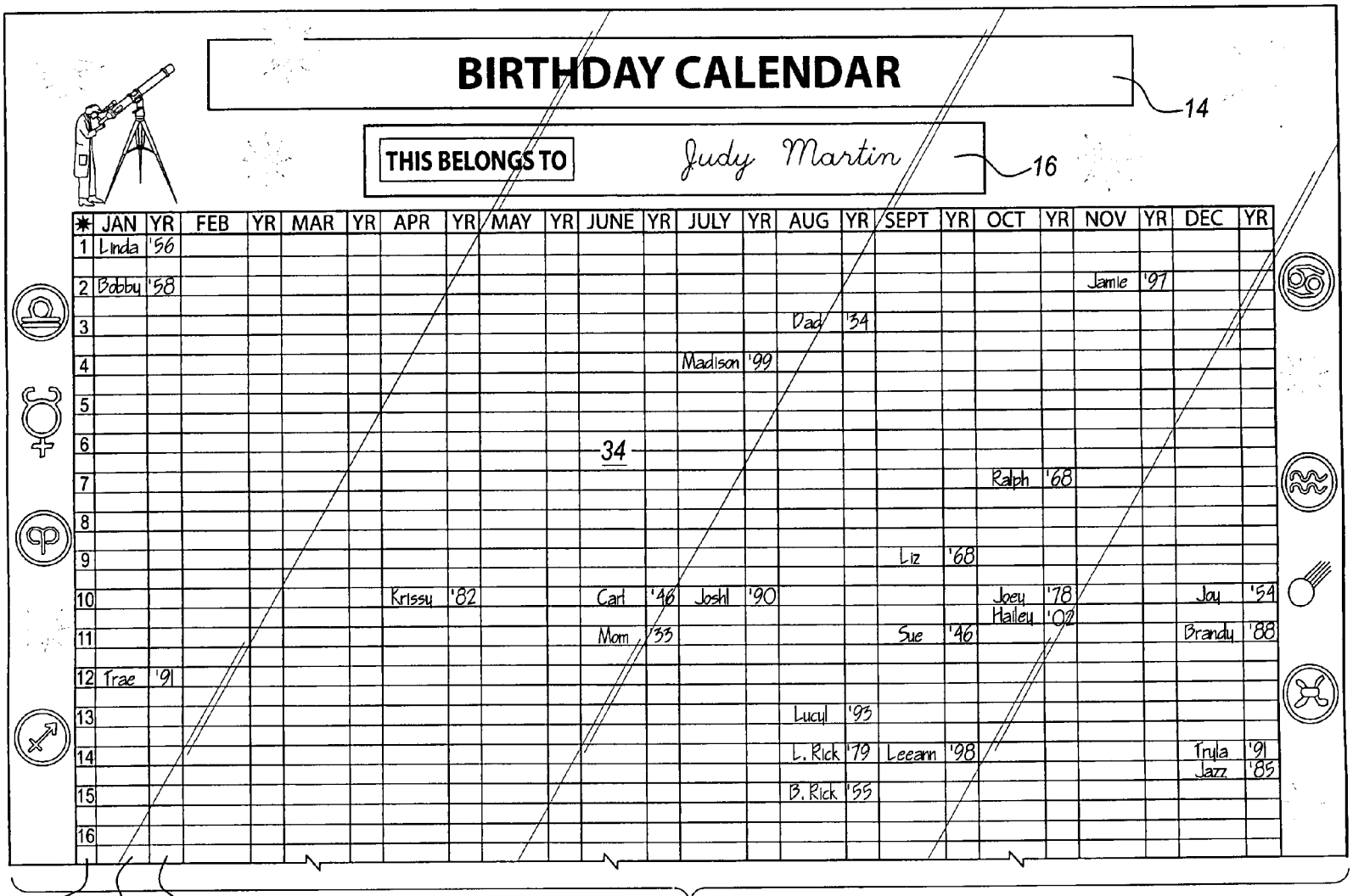
Figure 4B:
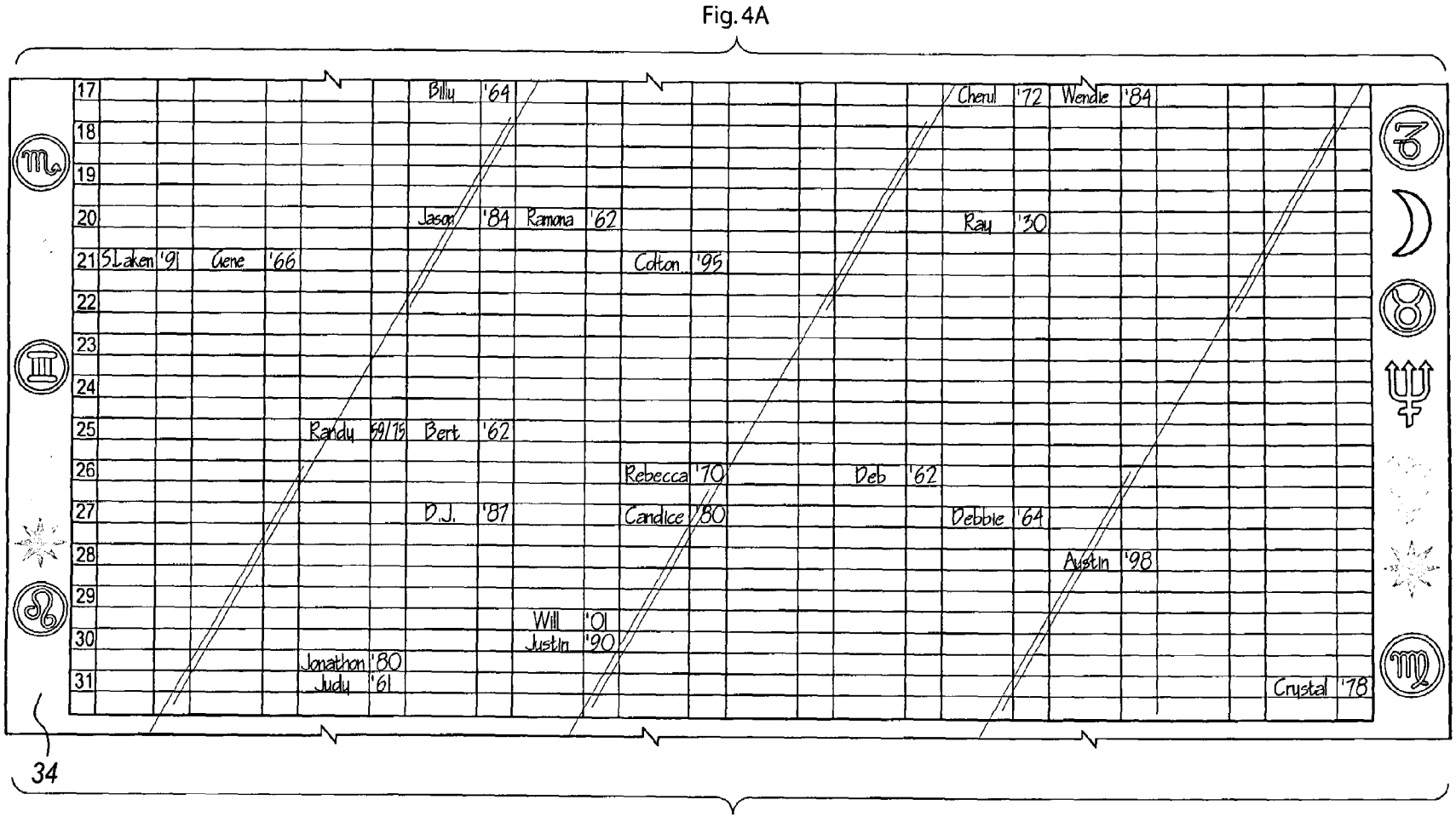
Figure 4C:
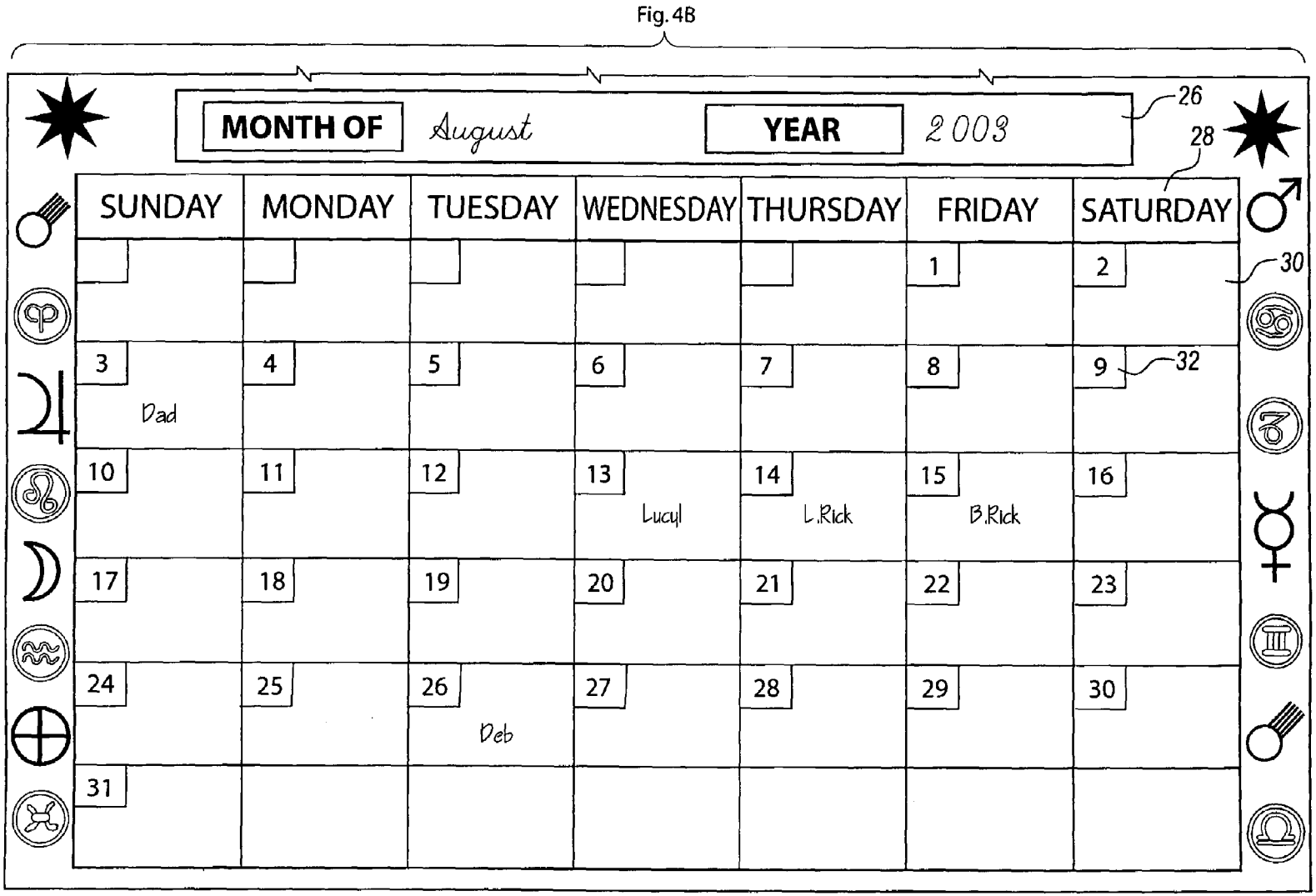

For illustrative purposes the calendar 10 is prepared for an exemplary individual, as shown in FIGS. 4A–4C. A number of birthdays are written into chart 12, FIGS. 4A–4B, by writing in the person's birth date in the appropriate date row and month column space and the year of the person's birth in the adjacent year space. For example, for a person named Lucyl born on Aug. 13, 1993, the owner of the calendar would go down the month column for August and across the date row for date number 13 and write in Lucyl's name in the appropriate space. Adjacent to that, the user would write in '93 or 1993 to indicate Lucyl's birth year in the year column.

In FIG. 4C, the monthly calendar 24 is dated for the month of August in the year 2003, as indicated in the date spaces 32 and month and year title section 26. As shown in the FIG. the monthly calendar 24 can also be used to insert memos or write in the names of people celebrating birthdays in the indicated months. Thus according to what is recorded in chart 12 in FIGS. 4A and 4B, "Dad" is written in the blank space 30 under, August 3 and "Deb" is written in the blank space 30 under August 26. By inserting the names in the monthly calendar 24 the user is able to see what day of the week the birthday will fall on.

Hence the birthday calendar 10 of the present invention provides a convenient and easy-to-use reference for remembering important dates and anniversaries.

It is to be understood that the present invention is not limited to the embodiments described above, but encompasses any and all embodiments within the scope of the following claims.

I claim:

1. A birthday calendar for recording birthdays and other annual dates, comprising:

a single sheet twelve-month chart made of an ink accepting material having vertical and horizontal parallel arranged intersecting lines imprinted thereon forming rows and columns and defining a plurality of memorandum spaces for permanently recording therein birthdays and other annually recurring events;

a transparent protective cover removably disposed over said twelve-month chart; and a monthly calendar joined to the chart such that the calendar and chart are simultaneously visible, said monthly calendar having imprinted thereon seven parallel vertical rows intersecting seven parallel horizontal columns defining memorandum spaces for removably imprinting birthdays and other monthly events therein as displayed on the chart, the monthly calendar having an erasable surface for reuse from month-to-month, wherein said monthly calendar is made from whiteboard.

2. The birthday calendar according to claim 1, wherein said chart has twenty-five columns intersected by a plurality of rows to define the plurality of memorandum spaces.

3. The birthday calendar according to claim 2, wherein columns two through twenty-five of the chart are grouped in pairs of adjacent columns, each pair having a first column corresponding to a month and a second column corresponding to a year.

4. The birthday calendar according to claim 1, wherein said protective cover is made from glass.

5. The birthday calendar according to claim 1, wherein said protective cover is made from plastic.

6. The birthday calendar according to claim 1, wherein said chart is made from paper.

7. The birthday calendar according to claim 1, wherein said chart further comprises indicia imprinted adjacent said memorandum spaces for designating a title and owner of the birthday calendar.

8. The birthday calendar according to claim 3, wherein the plurality of rows of the chart includes a top row, the first column of each pair of adjacent columns in the top row having indicia therein designating months from January through December displayed therein, the second column of each adjacent pair in the top row having indicia representing the word "year" displayed therein, whereby the top row defines a horizontal legend for the chart.

9. The birthday calendar according to claim 8, wherein said twenty-five columns includes a first column, the first column having indicia displayed therein representing numbers one through thirty-one in separate rows, whereby the first column defines a vertical legend for the chart, an intersection of one of the rows with one of the grouped pairs of adjacent columns defining the memorandum space for recording an event and a year in which the event occurred in order to permanently record the month, day and year of the event.

10. The birthday calendar according to claim 9, wherein said chart further comprises at least one blank row disposed between each of the rows displaying the indicia representing numbers one through thirty-one, whereby multiple events occurring on identical months and days may be permanently recorded.

* * * * *